US006439922B1

(12) United States Patent
Laurer et al.

(10) Patent No.: US 6,439,922 B1
(45) Date of Patent: Aug. 27, 2002

(54) VISUAL INDICATORS HAVING COMMON CATHODE LEADS, AND AN ELECTRICAL CONNECTOR USING SAME

(75) Inventors: Eric C. Laurer, Clemmons; Victor E. Slack, Lewisville, both of NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/957,316

(22) Filed: Sep. 19, 2001

Related U.S. Application Data

(60) Provisional application No. 60/233,959, filed on Sep. 20, 2000.

(51) Int. Cl.[7] ..... H01R 3/00
(52) U.S. Cl. ..... 439/490
(58) Field of Search ..... 439/490, 488, 439/910, 676

(56) References Cited

U.S. PATENT DOCUMENTS 4,978,317 A 12/1990 Pocrass ..... 430/490
4,992,704 A * 2/1991 Stinson ..... 315/312
5,685,737 A 11/1997 Morin et al. ..... 439/490
5,700,157 A 12/1997 Chung ..... 439/490
5,876,240 A * 3/1999 Derstine et al. ..... 439/490
5,924,890 A 7/1999 Morin et al. ..... 439/490
5,957,730 A 9/1999 Wang ..... 439/676
6,051,935 A * 4/2000 Bucks et al. ..... 315/224
6,120,318 A * 9/2000 Reed et al. ..... 439/490
6,162,089 A * 12/2000 Castello et al. ..... 439/541.5
6,174,194 B1 1/2001 Bleicher et al. ..... 439/490
6,203,379 B1 * 3/2001 Cai et al. ..... 439/676
6,227,911 B1 * 5/2001 Boutros et al. ..... 439/620
6,285,140 B1 * 9/2001 Ruxton ..... 315/312
6,315,612 B1 11/2001 Marchini et al. ..... 439/619

* cited by examiner

*Primary Examiner*—Tulsidas Patel

(57) ABSTRACT

A lighting device (50, 60) includes a pair of illuminating members (42, 62) arranged side-by-side. The illuminating members have separate anodes (44, 64), and a common cathode (46, 66) that is shared by the illuminating members. In one embodiment, the common cathode (66) has the same cross-sectional shape as each of the anodes (64). In another embodiment, the common cathode includes a pair of individual cathodes (46) that are soldered together. The lighting device is mountable in an electrical connector housing such that the pair of illuminating members is associated with a pair of adjacent electrical receptacles in the housing.

9 Claims, 5 Drawing Sheets

VISUAL INDICATORS HAVING COMMON CATHODE LEADS, AND AN ELECTRICAL CONNECTOR USING SAME

CROSS-REFERENCE TO RELATED APPLICATION

This application claims the benefit of U.S. Provisional Application No. 60/233,959 filed Sep. 20, 2000.

FIELD OF THE INVENTION

The invention relates to electrical connectors having visual indicators for displaying a connection status, and in particular, to a pair of visual indicators which form a subassembly that can be installed in an electrical connector as a unit.

BACKGROUND OF THE INVENTION

Electrical connectors having visual indicators are well-known. These connectors are typically mounted on a circuit board and are used for electrical connection between communication devices. The visual indicators are electrically connected to circuitry on the circuit board so as to indicate a particular electrical status condition such as the passage of a signal between communications devices. These visual indicators are typically light-emitting diodes (LED's) each having a pair of leads, one anode and one cathode. See, for example, U.S. Pat. Nos. 5,685,737 and 5,876,240.

Multiple electrical connectors and their associated visual indicators are often arranged side-by-side in a multi-port housing. The visual indicators take up significant space, thereby increasing the port-to-port centerline spacing compared with the spacing that would be required for a multi-port connector without visual indicators. Since it is desirable to minimize the size of electrical equipment, it is therefore desirable to reduce the size of multi-port electrical connectors by reducing the space between adjacent visual indicators, thereby reducing the centerline spacing between ports.

SUMMARY OF THE INVENTION

It is an object of the invention to provide a multi-port electrical connector having visual indicators in a compact package.

It is another object of the invention to minimize the space between adjacent visual indicators that can be used in an electrical connector.

These and other objects are facilitated by a lighting device comprising a pair of illuminating members that are arranged side-by-side, wherein the illuminating members have respective anodes, and a common cathode that is shared by the illuminating members.

According to one embodiment, the common cathode has the same cross-sectional shape as each of the anodes.

According to another embodiment, the common cathode includes a pair of individual cathodes that are soldered together.

The lighting device is mountable in an electrical connector housing. The side-by-side illuminating members are abutted together, thereby minimizing space requirements in the housing, and providing a compact electrical connector package.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
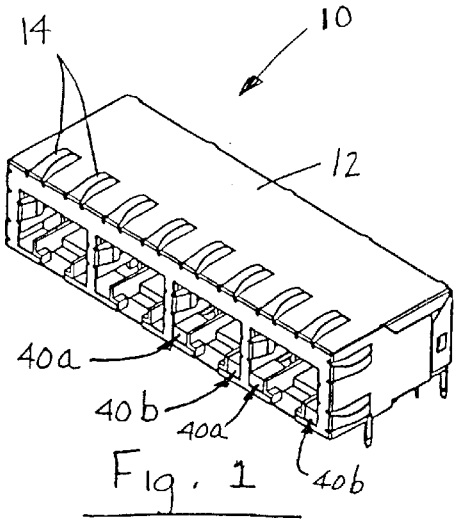
FIG. 1 is a top front isometric view of a multi-port electrical connector having visual indicator subassemblies according to the invention.
Figure 2:
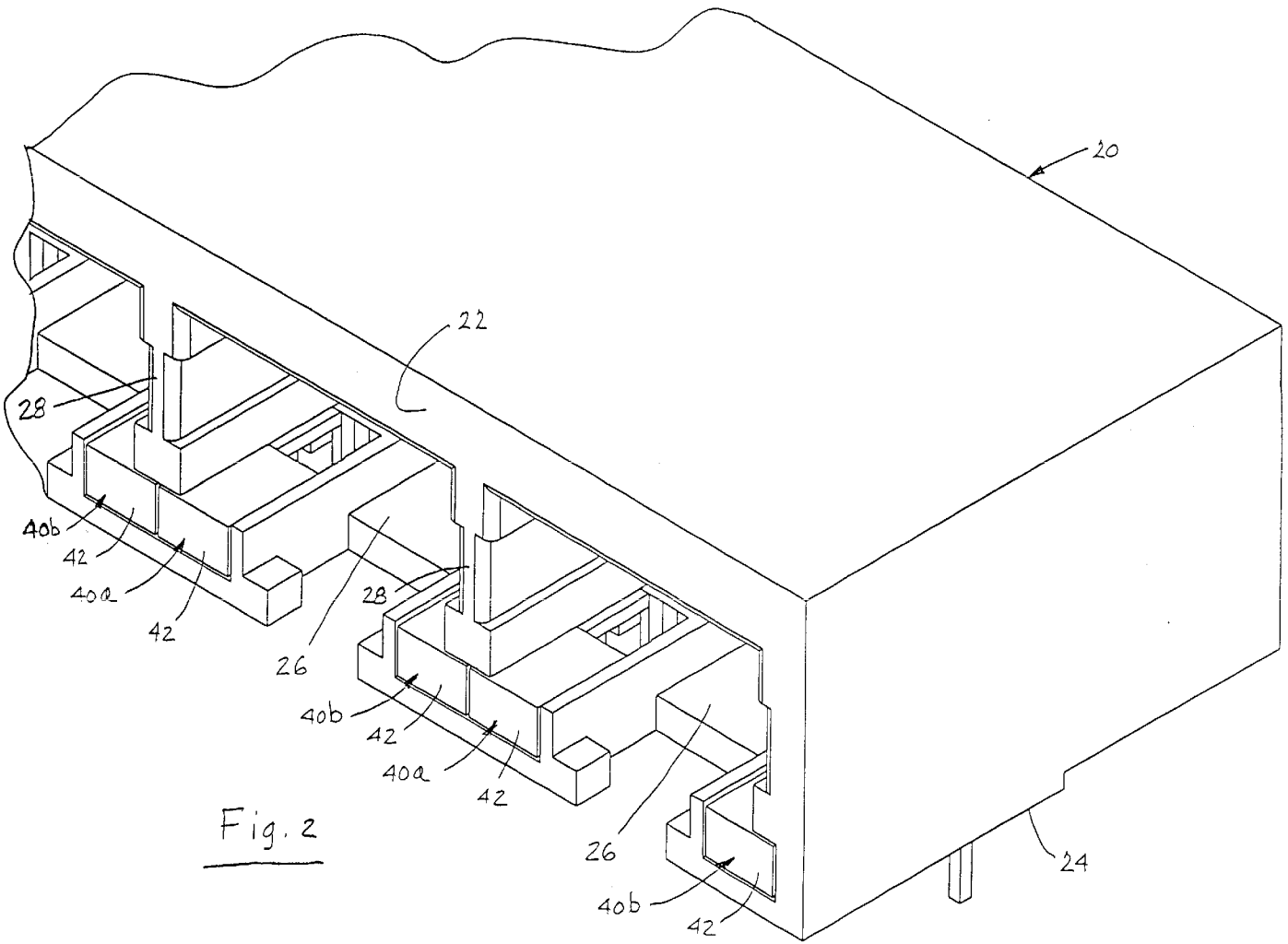
FIG. 2 is an enlarged top isometric view of a portion of the connector shown in FIG. 1, with a ground shield removed.
Figure 3:
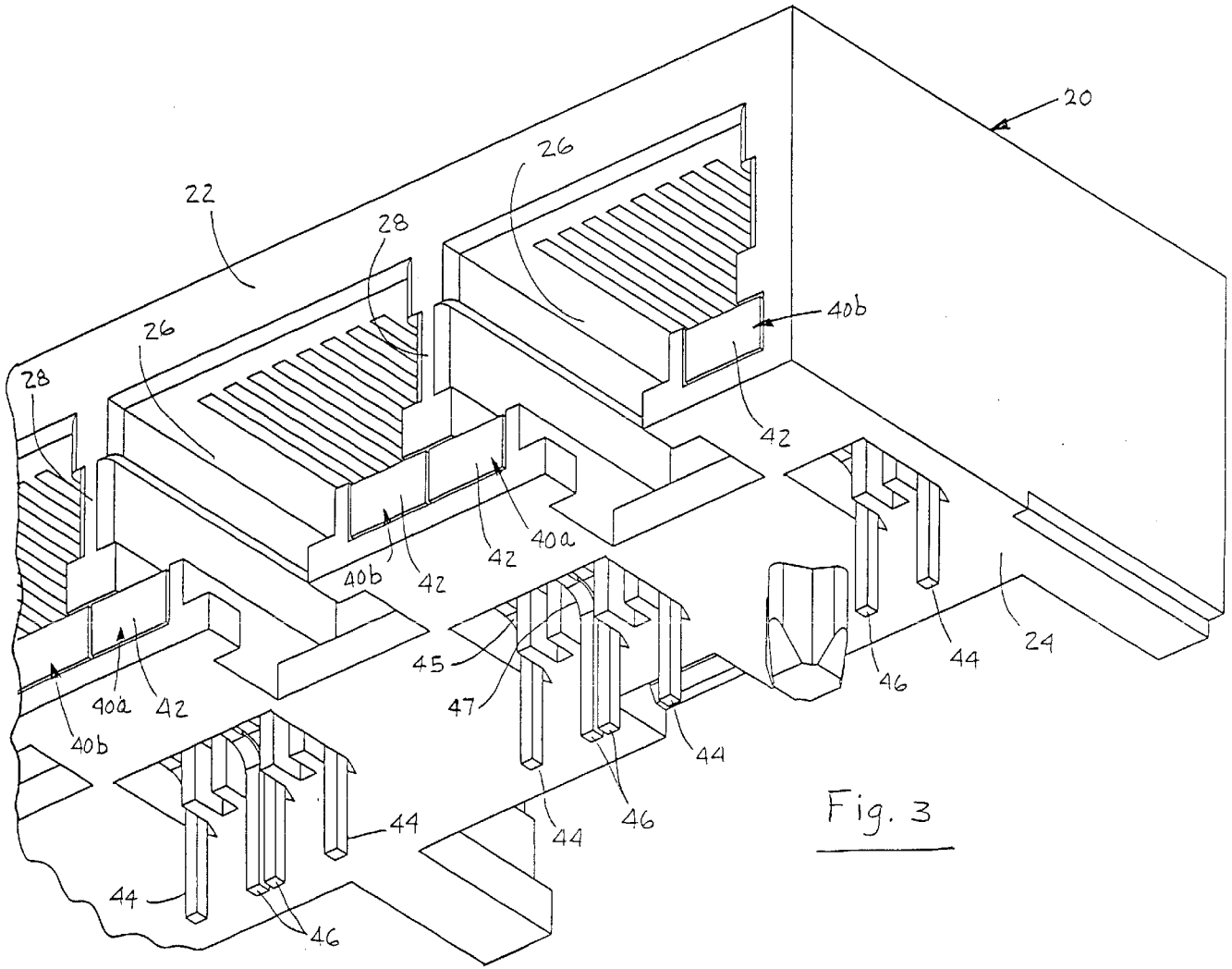
FIG. 3 is an enlarged bottom isometric view of a portion of the connector shown in FIG. 1, with a ground shield removed.

There is shown in FIG. 1 a multi-port electrical connector 10 including a housing that is surrounded by a conductive ground shield 12 having panel ground tabs 14. FIGS. 2 and 3 are enlarged views of a portion of the electrical connector shown in FIG. 1, with the ground shield removed.

The connector comprises an insulating housing 20 having a front mating face 22 and a circuit board mounting face 24. A plurality of cavities 26 are open into the housing through the front mating face 22. The cavities 26 are separated by divider walls 28 of the housing 20. Each of the cavities 26 is configured as a receptacle for an RJ-style modular plug (not shown).

Figure 4:
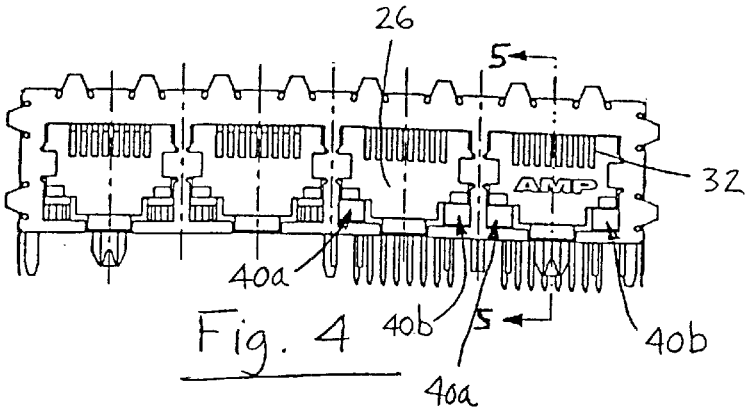
FIG. 4 is a front view of the connector.
Figure 5:
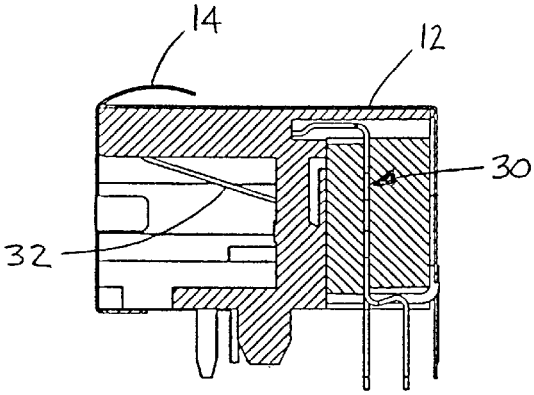
FIG. 5 is a cross-sectional view taken along line 5—5 in FIG. 4.

As shown in FIGS. 4 and 5, the housing holds arrays of terminals 30 which have mating end portions 32 that are exposed in the cavities 26 for engagement with contacts of the modular plugs (not shown) that are received in the cavities.

Referring back to FIGS. 2 and 3, the housing 20 holds visual indicators 40*a*, 40*b* that are exposed along the front face 22 of the housing. Two visual indicators are associated with each of the cavities 26, with one visual indicator 40*a* being disposed at one bottom corner of each cavity, and another visual indicator 40*b* being disposed at the other bottom corner of each cavity.

Each of the visual indicators 40*a*, 40*b* includes an illuminating member 42 having an anode lead 44 and a cathode lead 46 extending therefrom. The illuminating member may be, for example, a light-emitting diode (LED), although other types of illuminating members are considered to be within the scope of the invention. Each of the anode leads 44 and cathode leads 46 may be a 0.5 mm square lead frame or 0.51 mm round wire.

According to the invention, a visual indicator subassembly comprises a pair of visual indicators 40*a*, 40*b* arranged side-by-side and connected together for installation in the housing 20 as a unit. The side-by-side visual indicators of each visual indicator subassembly share cathode leads 46 that are commoned together.

Figure 6:
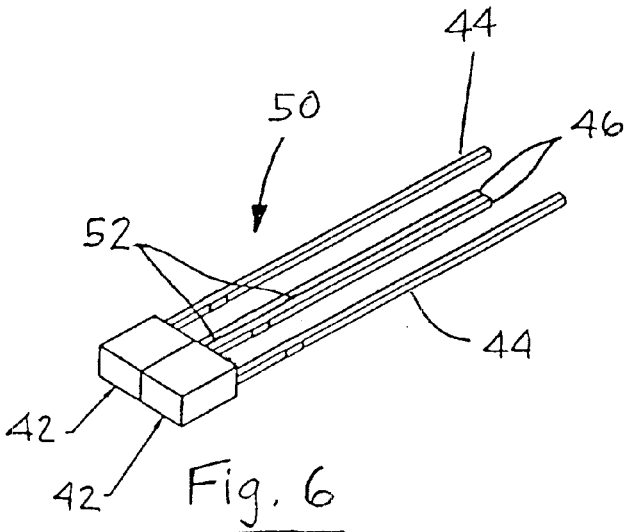
FIG. 6 is an isometric view of a visual indicator subassembly according to the invention.
Figure 7:
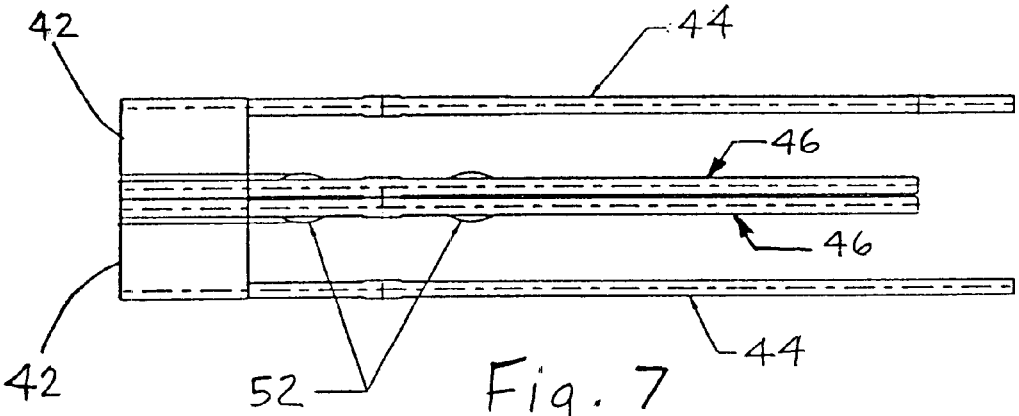
FIG. 7 is an enlarged top view of the visual indicator subassembly of FIG. 6.

According to one embodiment as shown in FIGS. 6 and 7, a visual indicator subassembly 50 comprises a pair of illuminating members 42 that are abutted together side-by-side. Extending from the illuminating members 42 are respective anode leads 44 and cathode leads 46. The individual cathode leads 46 are mechanically connected and electrically commoned such as by solder joints 52. The leads 44 and 46 are formed with respective bends 45 and 47, as best seen in FIG. 3, prior to insertion of the visual indicator subassembly into the connector housing.

Figure 8:
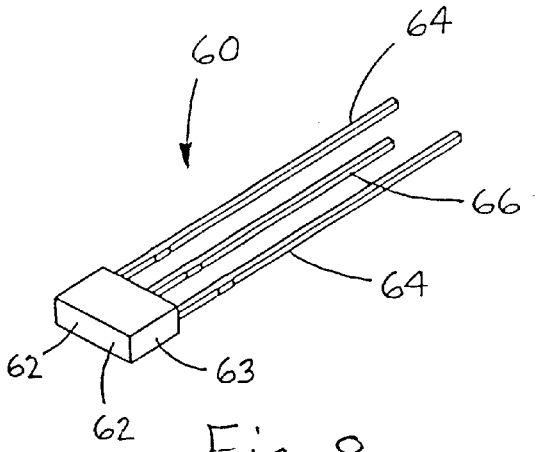
FIG. 8 is an isometric view of a visual indicator subassembly in an alternate embodiment.
Figure 9:
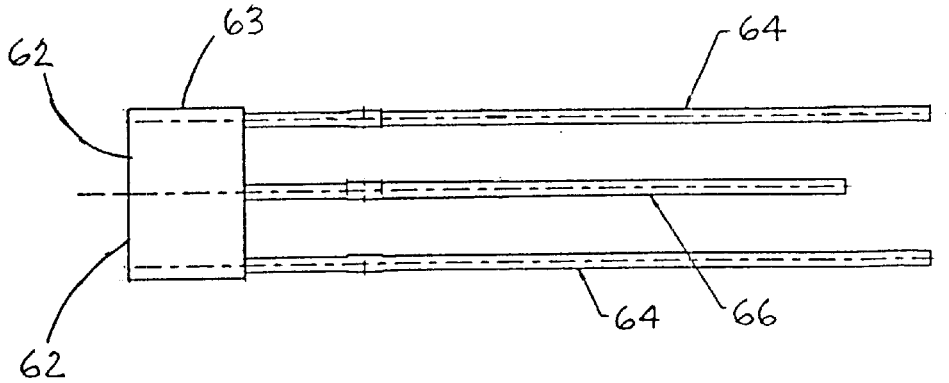
FIG. 9 is an enlarged top view of the visual indicator subassembly of FIG. 8.

According to another embodiment as shown in FIGS. 8 and 9, a visual indicator subassembly 60 comprises a pair of illuminating members 62 that are disposed side-by-side within a common light-conductive lens housing 63. The illuminating members 62 have respective anode leads 64 and a single cathode lead 66 having a cross-sectional configuration that is substantially the same as either one of the anode leads 64. The single cathode lead 66 is electrically connected to both of the illuminating members 62 within the lens housing 63. The single cathode lead 66 provides the same electrical function as the commoned cathode leads 46 in the previous embodiment, but uses less material and takes up less space than the commoned cathode leads.

Referring again to FIGS. 2, 3 and 6, a visual indicator subassembly 50 is centrally located below each of the divider walls 28 of the housing 20. The visual indicator subassembly 50 includes a visual indicator 40*a* that is associated with one of the cavities 26, and a visual indicator 40*b* that is associated with an adjacent one of the cavities 26. Thus, illuminating members 42 that are associated with adjacent cavities are arranged side-by-side and share a common cathode lead, thereby eliminating any space between adjacent illuminating members and their cathode leads.

The invention provides a pair of illuminating members which are mechanically joined together to form a subassembly. The illuminating members share a common cathode, thereby reducing size requirements. The subassembly can be installed into an electrical connector housing as a unit, thereby facilitating assembly of the electrical connector and providing a compact connector package.

We claim:

1. An electrical connector comprising:

a housing that includes a plurality of electrical receptacles, a respective array of contacts in each of the receptacles, and a visual indicator subassembly including a pair of illuminating members arranged side-by-side, the pair of illuminating members having respective anodes, and a common cathode that is shared by the pair of illuminating members, wherein the pair of illuminating members are associated with a pair of adjacent said receptacles.

2. The electrical connector of claim 1 wherein each of the illuminating members is a light-emitting diode.

3. The electrical connector of claim 1 wherein the common cathode has a same cross-sectional shape as each of the anodes.

4. The electrical connector of claim 1 wherein the common cathode includes a pair of individual cathodes that are soldered together.

5. The electrical connector of claim 1 wherein the housing includes a divider wall between said pair of adjacent said receptacles, and said visual indicator subassembly is disposed below said divider wall.

6. An electrical connector comprising:

a housing that includes a plurality of electrical receptacles, a respective array of contacts in each of the receptacles, and illuminating members associated with respective ones of the receptacles, wherein at least some of the illuminating members are arranged as subassemblies, each said subassembly including a pair of said illuminating members arranged side-by-side, each said pair of illuminating members having respective anodes, and a common cathode that is shared by said pair of illuminating members, wherein each said pair of illuminating members is associated with a pair of adjacent said receptacles.

7. The electrical connector of claim 6 wherein the housing includes a divider wall between the receptacles in each said pair of adjacent receptacles, and each said visual indicator subassembly is disposed below each said divider wall.

8. An electrical connector comprising:

a housing that includes a plurality of electrical receptacles, a respective array of contacts in each of the receptacles, and visual indicator subassemblies associated with pairs of adjacent said receptacles, each said subassembly including a pair of illuminating members arranged side-by-side, the pair of illuminating members having respective anodes, and a common cathode that is shared by the pair of illuminating members, wherein each said illuminating member is associated with a different one of said receptacles.

9. The electrical connector of claim 8 wherein the housing includes a divider wall between the receptacles in each said pair of adjacent receptacles, and each said visual indicator subassembly is disposed below each said divider wall.

* * * * *